US005123649A

United States Patent [19]

Tiberio

[11] Patent Number: 5,123,649

[45] Date of Patent: Jun. 23, 1992

[54] GAMING MACHINE WITH DYNAMIC PAY SCHEDULE

[75] Inventor: Dominic Tiberio, Las Vegas, Nev.

[73] Assignee: Bally Manufacturing Corporation, Chicago, Ill.

[21] Appl. No.: 723,869

[22] Filed: Jul. 1, 1991

[51] Int. Cl.[5] ..... A63F 5/04

[52] U.S. Cl. ..... 273/143 R

[58] Field of Search ..... 273/143 R, 138 A

[56] References Cited

U.S. PATENT DOCUMENTS 4,837,728 6/1989 Barrie et al. ..... 273/143 R 4,991,848 2/1991 Greenwood et al. ..... 273/143 R

FOREIGN PATENT DOCUMENTS 2131587 6/1984 United Kingdom ..... 273/143 R

*Primary Examiner*—Benjamin Layno

*Attorney, Agent, or Firm*—Jenner & Block

[57] ABSTRACT

A gaming machine having a dynamic pay schedule is provided. The machine selects a pay schedule from a set of pay schedules as a function of the number of coins inserted and the current state of the machine. The state of the machine is represented by an event counter which is incremented upon the happening of certain events. The current value of the counter is displayed. The predetermined pay schedules are ranked according to value of maximum payout. As the machine advances from one state to the next, pay schedules of successively higher rank are selected so that player's potential payout increases. At least one schedule has a progressive payout, which is periodically incremented upon the occurrence of predetermined events.

17 Claims, 5 Drawing Sheets

Fig. 3

50

| WINNING COMBINATIONS | PAYOUT AMOUNT | | | | | | |
|---|---|---|---|---|---|---|---|
| | 1 COIN | 2 COINS | 3 COINS | | | | |
| | | | ROUND 1-3 | ROUND 4-6 | ROUND 7-9 | ROUND 10-11 | ROUND 12 |
| A A A | 100 | 200 | 500 | 1000 | 1500 | 2000 | Pi |
| B B B | 50 | 100 | 150 | 300 | 450 | 600 | 600 |
| C C C | 25 | 50 | 75 | 150 | 225 | 300 | 300 |
| D D D | 24 | 48 | 48 | 48 | 48 | 48 | 48 |

52 54 56 58 60 62 64 66 68 72

GAMING MACHINE WITH DYNAMIC PAY SCHEDULE

FIELD OF THE INVENTION

The invention relates to the field of coin operated gaming machines, and more particularly to gaming machines that provide variable payouts relative to the value of a coin input.

BACKGROUND OF THE INVENTION

Widely known gaming devices have three to five rotatable reels arranged side by side with symbols, such as a lemon, cherry, bar, or the like placed on the peripheral surface thereof. There are also gaming machines which employ video displays in lieu of physical reels. In both the mechanical and video type gaming devices, a player inserts a token representing a value. The token may be coin, currency or the like. For convenience, all such tokens are referred to herein as simply "coins". The player then causes the reels to spin by pulling a handle located on the side of the machine or in some cases pressing a button. After a predetermined length of time, the reels are stopped to display the symbols. A determination is made as to whether the combination of displayed symbols matches a predetermined combination. If such a match occurs, the machine pays out a number of tokens in accordance with a predetermined payout amount which relates to the odds that the particular combination would occur.

Advances in gaming machine technology and in particular with respect to microprocessor controlled slot or reel type machines have made it possible to have variable payouts relative to the value of a coin input. For example, U.S. Pat. No. 4,624,459 discloses a machine capable of making multiple payouts at random intervals. Additionally, the virtual reel concept as disclosed in U.S. Pat. Nos. 4,448,419 and 4,711,451 has resulted in machines which have a maximum payout many thousands of times the value of the coin input.

It has been observed that players are more apt to play gaming machines for longer periods of time if the payout (and odds of winning) are increased as the player continues to play that particular machine. Further, players are more apt to insert additional coins if they perceive some continuing value from coins already expended.

SUMMARY

It is therefore an object of the present invention to provide a gaming machine, such as a reel-type slot machine, having a dynamic pay schedule. The gaming machine has a memory and a processor for randomly selecting and displaying as the game outcome a number of symbols. Predetermined combinations of the symbols result in corresponding payouts. The gaming apparatus includes a plurality of pay schedules contained in the memory, each of which includes a schedule of payout amounts corresponding to a predetermined combination of symbols. The processor includes logic responsive to a prior game outcome, to select one of the pay schedules. A pay circuit is operatively associated with the processor. If the game output includes a winning combination of symbols, a payout is produced by the pay circuit according to the selected pay schedule.

In one embodiment of the invention, at least one of the pay schedules include a payout amount corresponding to the contents of a progressive meter. In another embodiment of the invention, the selection logic uses an event counter operatively associated with the processor for counting the number of occurrences of at least one predetermined event corresponding to a prior game outcome. The selection logic includes logic for associating at least two of the plurality of pay tables with values (or in some cases a range of values) in the event counter, and selecting the pay table corresponding to the value in the event counter. The gaming machine may also include a sound device, such as a bell, for generating an audible sound when the event counter is incremented.

In another embodiment of the invention, the gaming apparatus includes a coin input for accepting coins inserted by a player. The pay schedules include a first and second pay schedule. The selection logic is responsive to the coin input for selecting the first pay schedule for coins having a first value, selecting the second pay schedule for coins having a second value, and selecting one of the remaining pay schedules associated with the value in the event counter for coins having a third value.

In another embodiment, the selection logic includes logic for resetting the event counter upon reoccurrence of a reset event. In some cases, the reset event is a predetermined game outcome. The reset event can also occur if a coin is not received within a predetermined amount of time. A display visible to the player displays the value of the event counter and another display displays the value of the progressive payout amount.

It is another object of the invention to provide a gaming apparatus having a plurality of symbol bearing reels mounted for rotation about an axis along with a coin input, a processor operatively connected to the coin input and the reels for initiating rotation and randomly stopping the reels in a predetermined position indicating a game outcome. A memory is operatively associated with the processor and contains a number of pay schedules, each of which defines a payout amount corresponding to the predetermined winning combinations of the symbols. Selection logic associated with the processor is responsive to a prior game outcome for selecting one of the pay schedules, and a pay mechanism operatively associated with the processor causes the apparatus to pay out according to the selected pay schedule.

BRIEF DESCRIPTION OF THE DRAWINGS

FIG. 3 is a chart representative of pay schedules according to an embodiment of the invention;

DETAILED DESCRIPTION OF THE INVENTION

Figure 1:
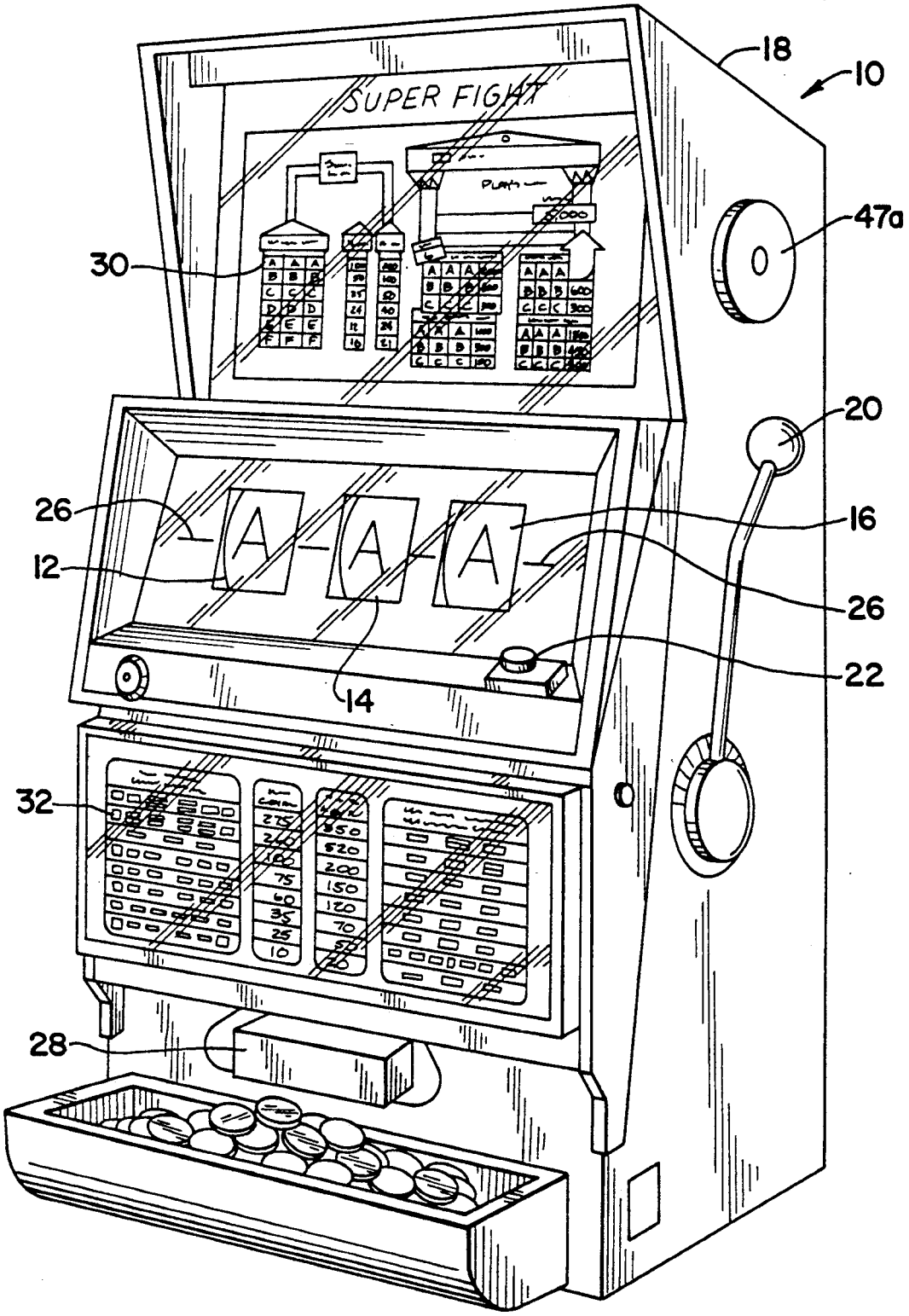
FIG. 1 is a perspective view of a reel-type gaming machine embodying the invention.
Figure 2:
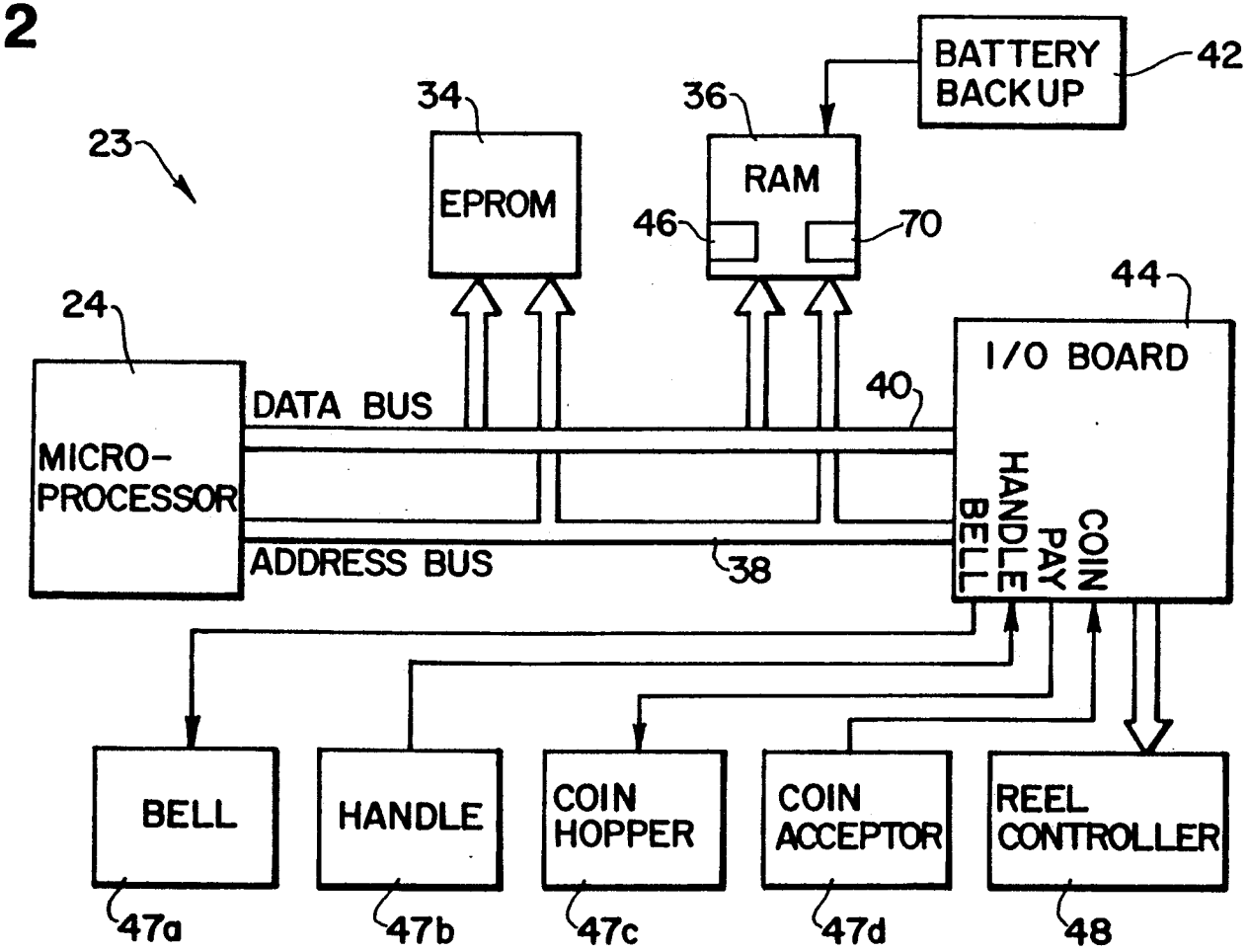
FIG. 2 is a block diagram of the electronic control circuit for the gaming machine of FIG. 1.

A representative example of a gaming machine 10, in this case a reel-type slot machine, employing the invention is shown in FIG. 1. The gaming machine 10 includes three symbol bearing reels 12, 14 and 16 (or a video display thereof) within a housing 18 which are caused to rotate in response to a player actuated handle 20 after one or more coins are inserted into a coin input slot 22. The gaming machine 10 includes an electronic control circuit 23, as shown in FIG. 2. The electronic control circuit 23 includes a microprocessor 24, which stops each of the reels 12 through 16 at random positions. As the reels 12 through 16 come to a stop, certain combinations of symbols (or "indicia") will appear adjacent to a win line 26 as shown in FIG. 1. The microprocessor 24 will determine if the combination of indicia stopped on the win line 26 matches one of a number of predetermined winning combinations. If a match is found, a win occurs and the microprocessor 24 generates a pay signal, which can cause a coin hopper (not shown in FIG. 1) to payout, through a payout chute 28, a specified number of coins or tokens, or increment a credit counter (not shown), or provide a signal to an attendant to provide the payout.

The number of coins dispensed for a win is generally controlled in relation to the odds that a particular combination will occur and the number of coins inserted by the player. In accordance with the invention, the number of coins dispensed for a particular winning combination of symbols is determined by a pay schedule. As discussed in greater detail below, a number of different of pay schedules are provided, each of which may be dynamically selected during operation of gaming machine 20. As is the convention in the gaming industry, these schedules are displayed in a top glass portion 32 and a belly glass portion 30 of the gaming machine 10.

The microprocessor 24 is preferably a Motorola 6800 processor. The microprocessor 24 controls the operation of the gaming machine 10 in accordance with programs and data stored in a digital memory such as an EPROM 34 and a RAM 36. The EPROM 34 and the RAM 36 are coupled to the processor 26 by an address bus 34 and a data bus 40. To preserve data in the event of a power failure, the RAM 32 is coupled to a battery backup circuit 42. The microprocessor 24 is also coupled via the address bus 38 and the data bus 40 to various input sensors and other peripherals through an input/output board 44. The RAM 36 also provides storage locations for an event counter 46, the contents of which may be successively incremented or decremented by the microprocessor 24, and a progressive meter 70, which is discussed in greater detail below.

In this embodiment of the invention, the microprocessor 24 is electronically coupled via the input/output board 44 to: a bell **47*a* that is responsive to a BELL signal which causes the bell 47*a* to emit an audible sound; a handle 47*b* (shown as 20 in FIG. 1) that generates a HANDLE signal which indicates when the handle 47*b* is pulled; a coin hopper 48*c* that is responsive to a PAY signal which causes the coin hopper 47*c* to dispense a designated number of coins; and a coin acceptor 47*d* that generates a COIN signal which indicates the number of coins inserted by a player into the coin slot 22**. The foregoing elements are conventional in the art.

In the gaming machine 10, the microprocessor 24 controls each of the reels 12 through 16 through a reel control mechanism 48. The reel control mechanism 48 includes a stepper motor or the like for each of the reels 12 through 16 to start and stop the rotation of the reels in accordance with the data on bus 40 from the microprocessor 24. The reel control mechanism 48 is also coupled to the input/output board 44 which is responsive to the microprocessor 24 for selecting a particular one of the stepper motor controls to receive control data from the data bus 40. In an alternative embodiment, the game control microprocessor 24 can display video representations of physical reels on a video monitor.

In the gaming machine 10, the microprocessor 24 randomly selects stop positions for each of the reels 12 through 16. Once the stop positions have been selected, the microprocessor 24 determines whether a win condition is present and, if so how much the payout should be. To this end, after the reel stops have been selected, the microprocessor 24 accesses a particular pay schedule from a set of pay schedules, which are stored in the EPROM 34.

An example of a set of pay schedules of the type used in gaming machine 10 is shown in a pay table 50 in FIG. 3. The pay schedules 50 are preferably stored in the non-volatile EPROM 34 along with other gaming machine 10 operating programs and control parameters. In the preferred embodiment the gaming machine 10 simulates a boxing match and the pay table 50 provides for increasing payouts as the match progresses through rounds 1 through 12. In the first column 52 of pay table 50 are listed the combination of symbols on reels 12 through 16 that form winning combinations. Of course, the depicted indicia are for purely illustrative purposes. In actual practice symbols such as bars and jackpot symbols are used. Additional columns 54 through 66 each specify one of the plurality of pay schedules which microprocessor 24 can utilize for determining the payout amount for the winning combination of symbols shown in the column 52.

In the preferred embodiment, the microprocessor 24 selects one of the pay schedules set forth in columns 54 through 66 by examining the COIN signal and the contents of the event counter 46. If a player inserts only one coin into the coin slot 22 prior to pulling the handle 20, then the microprocessor 24 selects the pay schedule set forth in the column 54. If the player inserts two coins, the microprocessor 24 selects the pay schedule set forth in the column 56. If the player inserts three coins, the microprocessor 24 examines the contents of the event counter 46. Each of the schedules set forth in the columns 58 through 66 is assigned to a range of values which the event counter 46 may contain. In this example, the event counter 46 contains the number of the round in the simulated boxing match. The microprocessor 24 selects the pay schedule whose assigned range includes the current value of the contents of the event counter 46. In the embodiment shown in FIG. 3, the pay schedules set forth in columns 58 through 66 have been assigned rounds 1–3, 4–6, 7–9, 10–11, and 12, respectively These assignments are illustrated in row 68.

Preferably, the event counter 46 contains the value 1 when initialized and is incremented by the microprocessor 24 upon the occurrence of certain events. Events which cause the counter 46 to be incremented can include the insertion of a coin or the occurrence of certain positions of reels 12 through 16, such as a "round" or advance symbol centered on the win line 26 of the center reel 14. The event counter 46 is not incremented once it reaches a predetermined upper limit, which in the above embodiment is 12. In this embodiment, each time microprocessor 24 increments the event or round counter 46, it causes the bell **47*a* to ring by generating the BELL signal resulting in an audible indication to the player that the round has advanced. As described in greater detail below, the counter 46 is reinitialized on the occurrence of certain other events. It will be observed that the selection of pay schedules can be solely a function of the contents of event counter 46** and not the coin input signal.

It should also be noted that the counter 46 and hence the pay schedule can be decremented upon the occurrence of certain events in other embodiments of the invention.

Preferably, the set of pay schedules set forth in columns 58 through 66 is ranked in ascending order of payout amounts. The pay schedule shown in column 66 with the progressive payout amount is ranked highest. The above-described assignment of numerical ranges is correlated with the rank, so that as the event counter 46 is incremented, the microprocessor 24 progressively selects the pay schedule in rank order.

During normal gaming machine 10 operation, the microprocessor 24 after selecting the stop positions of reels 12 through 16 determines which symbols on the reels 12 through 16 are stopped at win line 26, and searches column 52 in pay table 50 for a winning combination of symbols. If a match is located, microprocessor 24 locates a pay amount in the row corresponding to the winning combination in that one of the columns 54 through 66 which contains the selected schedule. The microprocessor 24 then generates the PAY signal through input/output chip 44 which causes a coin hopper 47*c* to pay out through the coin chute 28 that number of coins equivalent to the selected payout amount.

In accordance with the invention and as illustrated in column 66 of FIG. 3, one of the pay schedules contains a variable payout amount for a particular winning combination. This variable payout amount is referred to as the "progressive payout amount", and is designated in FIG. 3 as $P_i$. Alternatively, other variable payout amounts could be provided in accordance with the invention for other winning combinations and in other pay schedules. In the embodiment shown in FIG. 3, the progressive payout amount $P_i$ is contained in the highest ranked pay schedule 66 and is paid in response to the highest paying winning combination AAA. However, it is considered preferable to make the progressive amount $P_i$ available in each of the pay schedules set forth in columns 58 through 66 for the highest or jackpot symbols AAA. The progressive payout amount is generated by the progressive meter 70 contained the RAM 36. The progressive meter 70 is a memory location in RAM 36 which contains the current value of progressive payout amount. The contents of the progressive meter 70 are periodically incremented by a predetermined amount on the occurrence of a predetermined event. Preferably, the progressive meter 70 is initialized at a value which exceeds the highest payout amount of all other payout schedules, and is incremented by a predetermined amount such as $1.00. Events which cause the progressive meter 70 to be incremented can include the insertion of a coin through the coin slot 22 or the occurrence of certain stopped positions of the reels 12 through 16.

The progressive meter 70 is reset upon the occurrence of certain predetermined events. Typically, the progressive meter 70 is reset when the microprocessor 24 generates the PAY signal to pay a jackpot.

Figure 4:
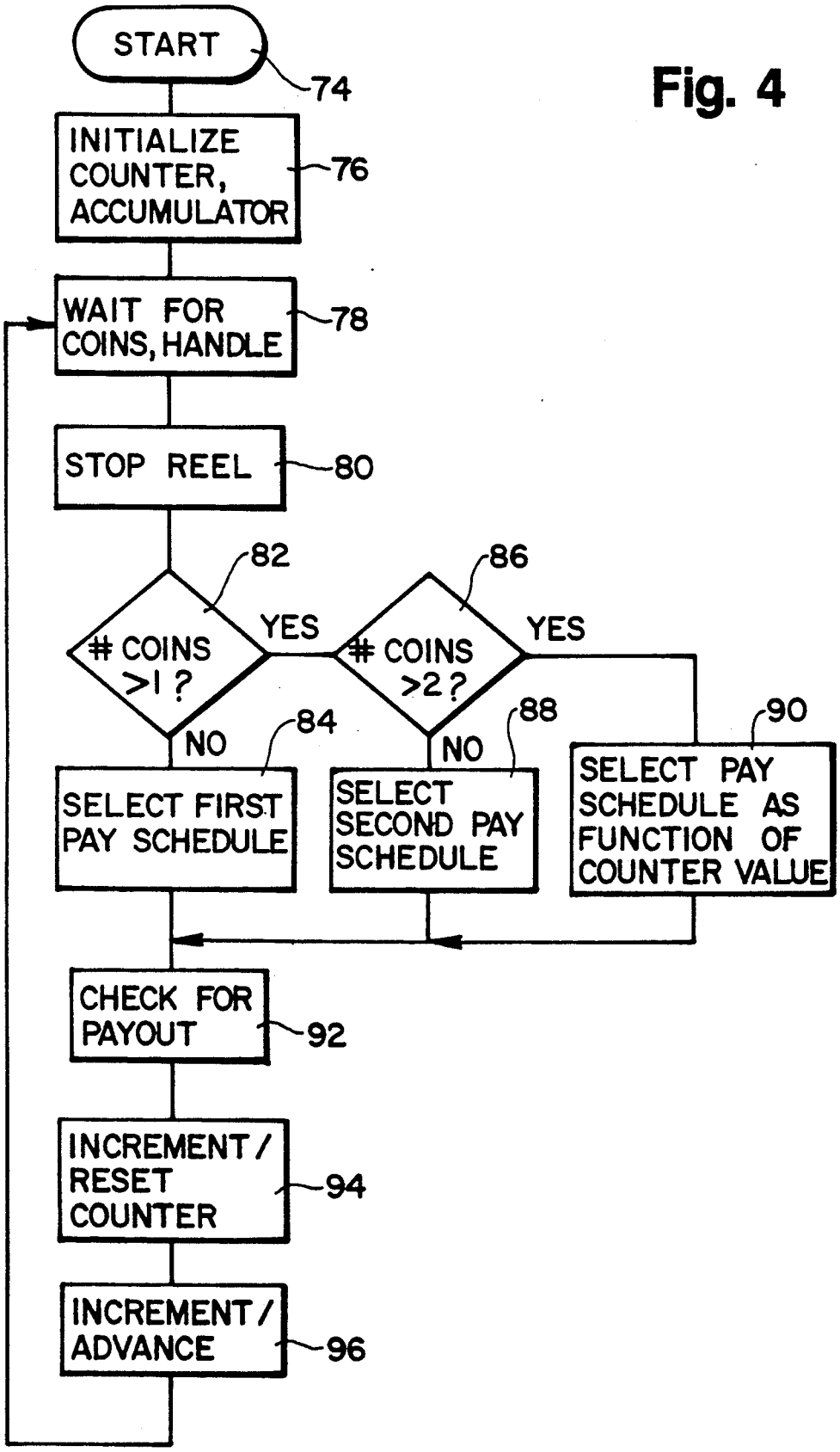
FIG. 4 is a logic flow chart illustrating control of the reel-type gaming machine of FIG. 1 in accordance with the invention.

Various computer programming approaches for implementing the foregoing functions will be apparent to those skilled in the art. By way of illustration, FIG. 4 is a logic flowchart illustrating control of the reel type gaming machine 10 shown in FIG. 1. At a block 74 as shown in FIG. 4 the gaming machine 10 is initialized. At a block 76 the event counter 46 is initialized to the value 1, and the progressive meter 70 is initialized to a predetermined value, which in the illustrated embodiment is $2,500. At a block 78 the gaming machine 10, after a player inserts coins into the coin slot 22 and pulls the handle 20, randomly selects stop positions for the reels 12 and 16 and then rotates the reels 12 through 16. Then control moves to a block 80 where the microprocessor 24 stops the reels 12 through 16 at the selected step positions. Control then moves to a decision block 82, where the microprocessor 24 interrogates the COIN signal to determine how many coins have been inserted for that handle pull. If only one coin has been inserted, control moves to a block 84 where the microprocessor 24 selects the first pay schedule, set forth in the column 54 of the pay table 50. If more than one coin has been inserted, control moves to a decision block 86. If two coins have been inserted, control moves to a block 88 where the microprocessor 24 selects the second pay schedule, set forth in the column 56 of the pay table 50. If three coins have been inserted, then microprocessor 24 moves to a block 90 where it selects one of the pay schedules set forth in the columns 58 through 66. As described above, each such selection corresponds to the contents of counter 46.

After executing the block 84, 88 or 90, control moves to a block 92 where microprocessor 24 determines if the reels 12 through 16 have stopped in a winning position, as described above. If a winning combination exists, the microprocessor 24 causes the coin hopper to dispense the payout indicated by the selected pay schedule. If the selected pay schedule is that set forth in the column 66 of the pay table 50, then the payout will be the progressive payout amount $P_i$ where the reels display the highest winning combination AAA.

Control then moves to a block 94 where the event counter 46 is incremented if a predetermined condition exists such as the presence of an advance symbol on the win line 26, as discussed above. In the preferred embodiment the event counter 46 is reset to 1 if less than three coins are entered by the player at the block 78. The event counter 46 can also be reset if a coin is not inserted within a predetermined amount of time, such as within 30 seconds. To this end, the microprocessor 24 may utilize a timer (not shown) which is reset each time the handle 20 is pulled. Preferably, the event counter 46 is reset whenever a jackpot is won.

Control then moves to a block 96, where the progressive meter 70 is incremented by a predetermined amount such as an amount for each coin input. The progressive meter 70 can also be incremented upon the occurrence of other events as well. Preferably the progressive meter 70 is reinitialized to the predetermined minimum value when the microprocessor 24 generates the PAY signal corresponding to the progressive pay amount $P_i$.

Upon completion of processing at block 96, control returns to block 78. Steps 78 through 96 are repeated continuously as described above until gaming machine 10 is turned off.

Figure 5:
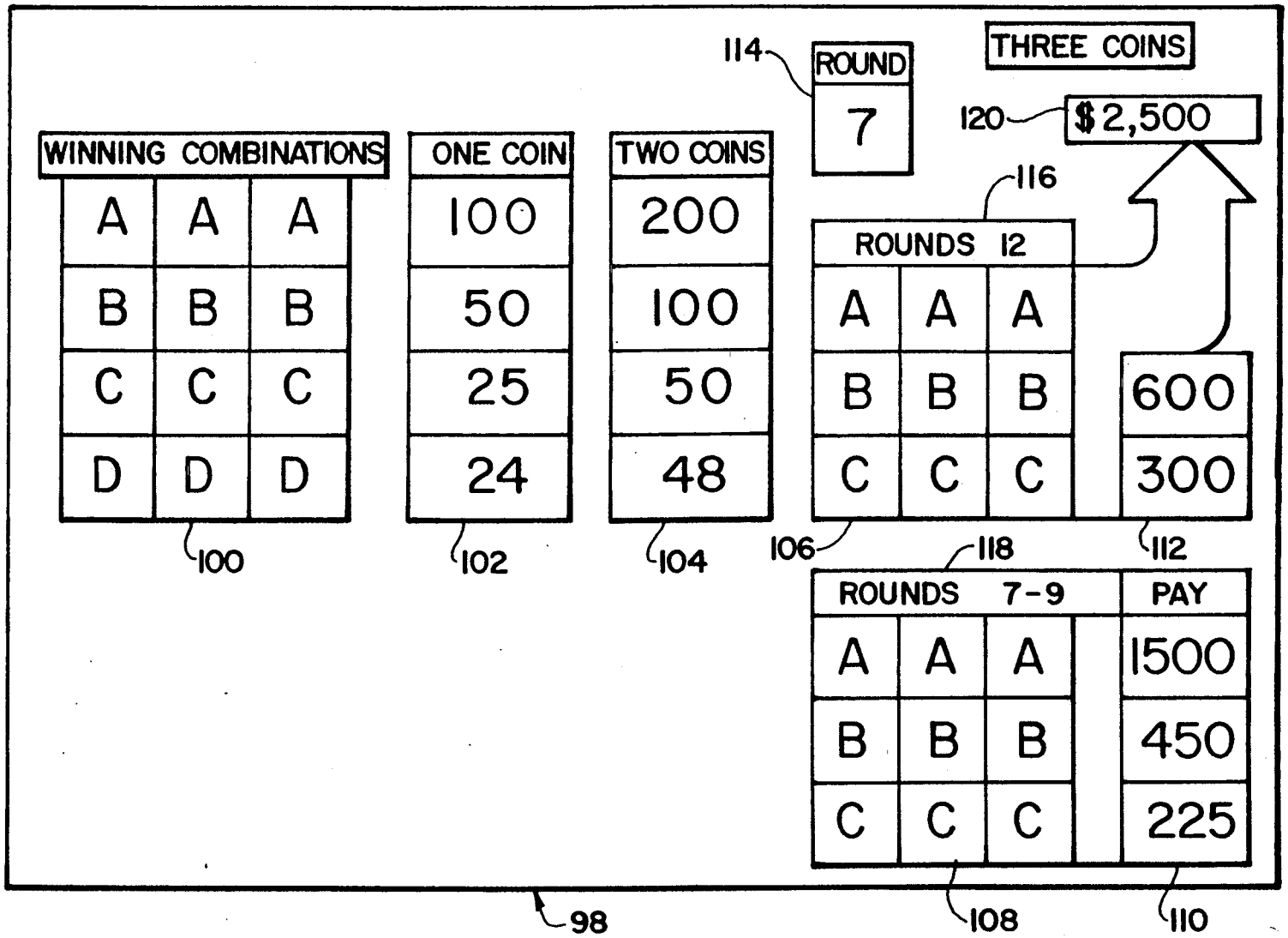
FIG. 5 is an illustration of the top glass display of the reel-type gaming machine of FIG. 1 according to an embodiment of the invention.

FIG. 5 provides an illustration of a top glass 98 which is a simplified version of the top glass 30 of FIG. 1 and corresponds to the pay schedules contained in the pay table 50. For clarity, only four pay schedules are depicted in FIG. 5. In practice, on most gaming machines 10 all pay schedules are displayed on the top glass 30. On the glass 98 a column 100 displays winning combinations of the reels 12 through 16, and corresponds to the column 52 of the pay table 50. A pair of columns 102 and 104 display payout amounts for one and two coins inserted, respectively. The column 102 corresponds to the pay schedule set forth in the column 54 of the pay table 50, and the column 104 corresponds to the pay schedule set forth in the column 56 of the pay table 50.

Likewise, columns 106 and 108 display winning combinations of reels 12 through 16. The column 110 displays the pay schedule set forth in the column 62 of the pay table 50 and the column 112 displays the pay schedule of the column 66 of the pay table 50. In the preferred embodiment, the top glass 98 is stylized in a boxing match motif. Therefore, the contents of the event counter 46 are displayed by an LED or like display in a box 114 under the heading "Round". Accordingly, the pay schedule set forth in the column 112 of the top glass 98 (and the column 66 of the pay table 50) is visually associated with a label 116 which reads "Round 12". It will be observed that the number 12 is the value of the event counter 46 which cause the microprocessor 24 to select the pay schedule set forth in the column 66. Similarly, the pay schedule set forth under column 110 of the top glass 98 (and the column 62 of the pay table 50) is visually associated with label 118 which reads "Rounds 7-9". The numbers 7 through 9 are the range of values of the counter 40 which cause the microprocessor 24 to select the pay schedule set forth in the column 62.

In FIG. 5, the box 114 displays the number "7" which as described above indicates that the pay schedule set forth in the column 110 is the currently selected pay schedule.

The payout value $P_i$ in row 72 of the pay schedule set forth in the column 66 of the pay table 50 is of variable value which was defined above as the progressive payout amount. The current value of the progressive payout amount is stored in the progressive meter 70 portion of the RAM 36, and displayed by an LED or like display in a box 120. For example, the box 120 in FIG. 5 contains the value $2,500. Thus, if the Round (i.e. counter value) is 12 and the reels 12 through 16 display winning combination "AAA", then the microprocessor 24 generates the PAY signal causing coin hopper 47c or signaling an attendant to dispense $2,500 to the player.

In order to facilitate the high values of the progressive payout amount, the preferred embodiment of the invention, as implemented in gaming machine 10, utilizes a non-uniform type stop mechanism. Such a mechanism is disclosed in U.S. Pat. No. 4,991,848 which is hereby incorporated by reference.

I claim:

1. A gaming apparatus having a memory and a processor for randomly selecting and displaying as a game outcome a plurality of indicia wherein predetermined combinations of the indicia result in corresponding payouts comprising:

a plurality of pay schedules contained in the memory wherein each of said pay schedules includes a schedule of payout amounts corresponding to a predetermined combination of the indicia;

selection means responsive to a prior game outcome for selecting one of said plurality of pay schedules wherein said selection means includes an event counter operatively associated with the processor for counting the number of occurrences of at least one predetermined event in a prior game outcome; and wherein said selection means includes means for associating at least two of said plurality of pay schedules with different values in said event counter and selecting the pay schedule corresponding to the value in said event counter;

and pay means operatively associated with the processor and said selection means for generating a pay signal representing one of the payout amounts according to said selected pay schedule.

2. The gaming apparatus of claim 1, wherein each of said pay schedules is associated with a range of said values in said event counter.

3. The gaming apparatus of claim 1 further including sound means operatively associated with the processor for generating an audible sound when said event counter is incremented.

4. The gaming apparatus of claim 1 wherein said predetermined event is a display of at least one predetermined indicia.

5. The gaming apparatus of claim 1 wherein said event counter is decremented upon the occurrence of at least one predetermined event.

6. The gaming apparatus of claim 1 further comprising an input means for receiving a coin from a player; wherein said plurality of pay schedules include a first and second pay schedule, wherein said selection means are responsive to said coin input means for selecting said first pay schedule for a first coin input, selecting said second pay schedule for a second coin input, and selecting one of said pay schedules associated with said value in said event counter for a third coin input.

7. The gaming apparatus of claim 1 wherein said selection means includes counter resetting means for resetting said event counter upon the occurrence of a reset event.

8. The gaming apparatus of claim 7 wherein said reset event is a predetermined game outcome.

9. The gaming apparatus of claim 7 further comprising coin input means for receiving a coin from a player; wherein said reset event occurs if a coin is not received by said coin input means within a predetermined amount of time.

10. The gaming apparatus of claim 1 further comprising means for displaying the value of said event counter.

11. The gaming apparatus of claim 1 further comprising means for displaying a progressive payout amount.

12. A gaming apparatus having a plurality of symbol bearing reels mounted for rotation about an axis comprising:

coin input means for receiving coins from a player;

a processor operatively connected to said input means and said reels for initiating rotation and randomly stopping the reels at a predetermined position indicating a game outcome in response to at least one coin being received from a player;

a memory operatively associated with said processor containing a plurality of pay schedules, wherein each of said pay schedules is comprised of payout amounts corresponding to predetermined combinations of said symbols;

detection means operatively associated with said processor identifying the symbols located at said predetermined position;

selection means operatively associated with said processor responsive to a prior game outcome for selecting one of said plurality of pay schedules; wherein said selection means includes an event counter operatively associated with said processor for counting the number of occurrences of at least one predetermined event corresponding to a prior game outcome; and wherein said selection means includes means for associating at least two of said plurality of pay schedules with different values in said event counter and setting the pay schedule corresponding to the value in said event counter;

pay means operatively associated with said detection means and said memory for generating a pay signal according to the selected pay schedule.

13. The gaming apparatus of claim 12, wherein each of said pay schedule is associated with a range of said values in said event counter.

14. The gaming apparatus of claim 12 further including sound means operatively associated with said processor for generating an audible sound when said event counter is incremented.

15. The gaming apparatus of claim 12 wherein said plurality of pay schedules include a first and second pay schedule, wherein said selection means are responsive to said coin input means for selecting said first pay schedule for a first coin input, selecting said second pay schedule for a second coin input, and selecting one of said pay schedules associated with said value in said event counter for a third coin input.

16. The gaming apparatus of claim 12 wherein said predetermined event occurs when a predetermined combination of symbols is located at said predetermined position.

17. The gaming apparatus of claim 12 wherein said event counter is decremented upon the occurrence of at least one predetermined event.

* * * * *

UNITED STATES PATENT AND TRADEMARK OFFICE

CERTIFICATE OF CORRECTION

PATENT NO. : 5,123,649

DATED : June 23, 1992

INVENTOR(S) : Dominic Tiberio

It is certified that error appears in the above-identified patent and that said Letters Patent is hereby corrected as shown below:

Column 9, claim 12, line 4, change "setting" to --selecting--

Signed and Sealed this

Eighth Day of February, 1994

Bruce Lehman

*Attest:*

BRUCE LEHMAN

*Attesting Officer*

*Commissioner of Patents and Trademarks*